US011217406B2

(12) United States Patent
Urayama et al.

(10) Patent No.: US 11,217,406 B2
(45) Date of Patent: Jan. 4, 2022

(54) MULTI-DIRECTIONAL INPUT DEVICE

(71) Applicant: Alps Alpine Co., Ltd., Tokyo (JP)

(72) Inventors: Shinya Urayama, Miyagi-ken (JP); Toshio Imai, Miyagi-ken (JP); Sachio Taguchi, Miyagi-ken (JP)

(73) Assignee: Alps Alpine Co., Ltd.

( * ) Notice: Subject to any disclaimer, the term of this patent is extended or adjusted under 35 U.S.C. 154(b) by 0 days.

(21) Appl. No.: 17/032,021

(22) Filed: Sep. 25, 2020

(65) Prior Publication Data

US 2021/0012985 A1 Jan. 14, 2021

Related U.S. Application Data

(63) Continuation of application No. PCT/JP2019/007838, filed on Feb. 28, 2019.

(30) Foreign Application Priority Data

Apr. 11, 2018 (JP) ..... JP2018-075905

(51) Int. Cl.
*H01H 19/14* (2006.01)
*H01H 19/04* (2006.01)
*H01H 19/20* (2006.01)

(52) U.S. Cl.
CPC ..... *H01H 19/14* (2013.01); *H01H 19/04* (2013.01); *H01H 19/20* (2013.01); *H01H 2215/00* (2013.01)

(58) Field of Classification Search
CPC ..... H01H 2003/008; H01H 2215/00; H01H 13/85; H01H 2215/03; H01H 19/08; H01H 19/626; H01H 13/14; H01H 13/28; H01H 13/54; H01H 13/64; H01H 19/02; H01H 19/14; H01H 19/04; H01H 19/20;
(Continued)

(56) References Cited

U.S. PATENT DOCUMENTS

2009/0050465 A1* 2/2009 Asada ..... H01H 25/06 200/6 A

FOREIGN PATENT DOCUMENTS

JP 2004-071451 A 3/2004
JP 2004-086424 A 3/2004
(Continued)

OTHER PUBLICATIONS

International Search Report for corresponding Application No. PCT/JP2019/007838 dated Jun. 4, 2019 (1 page).
(Continued)

*Primary Examiner* — Ahmed M Saeed
(74) *Attorney, Agent, or Firm* — Harness, Dickey & Pierce, P.L.C.

(57) ABSTRACT

A multi-directional input device includes an operation knob, a plurality of direction setting switches, and a sensation generation unit. The operation knob is configured to be operable in multiple operation directions. The plurality of direction setting switches are configured to be turned on by being pressed when the operation knob is operated. The sensation generation unit is configured to generate different operation sensation from operation sensation generated by the direction setting switches. Sensation is generated by the sensation generation unit after at least one of the plurality of direction setting switches has been turned on in a predetermined operation direction out of the multiple operation directions.

11 Claims, 15 Drawing Sheets

(58) Field of Classification Search
CPC ..... H01H 3/12; H01H 13/48; H01H 13/702;
H01H 13/70; H01H 13/7073; H01H 3/02
See application file for complete search history.

(56) References Cited

FOREIGN PATENT DOCUMENTS

| | | | |
|---|---|---|---|
| JP | 2005-032486 | A | 2/2005 |
| JP | 2015-216027 | A | 12/2015 |

OTHER PUBLICATIONS

Notice of Reasons for Refusal issued by the Japanese Patent Office for corresponding Japanese Patent Application No. 2020-513110; dated Jul. 6, 2021 (total 7 pages).

* cited by examiner

MULTI-DIRECTIONAL INPUT DEVICE

CROSS REFERENCE TO RELATED APPLICATIONS

This application is a Continuation of International Application No. PCT/JP2019/007838 filed on Feb. 28, 2019, which claims benefit of Japanese Patent Application No. 2018-075905 filed on Apr. 11, 2018. The entire contents of each application noted above are hereby incorporated by reference.

BACKGROUND OF THE INVENTION

1. Field of the Invention

The present invention relates to a multi-directional input device.

2. Description of the Related Art

There exists a known multi-directional input device in which an elastic member is elastically deformed by operating an operation member operable in multiple directions so as to bring a movable contact portion corresponding to an elastically deformed portion into contact with fixed contact portions on a board, thereby turning on a switch.

Examples of related art include Japanese Unexamined Patent Application Publication No. 2015-216027.

SUMMARY OF THE INVENTION

However, when the switch is turned on only by elastically deformation of the elastic member, an operator is, in some cases, unlikely to obtain a clear sensation of turning on of the switch in a desired direction.

The present disclosure provides a multi-directional input device with which an operator is likely to obtain a clear sensation of turning on of a switch in a desired direction.

A multi-directional input device according to an aspect of the present disclosure includes an operation knob, a plurality of direction setting switches, and a sensation generation unit. The operation knob is configured to be operable in multiple operation directions. The plurality of direction setting switches are configured to be turned on by being pressed when the operation knob is operated. The sensation generation unit is configured to generate different operation sensation from operation sensation generated by the direction setting switches. Sensation is generated by the sensation generation unit after at least one of the plurality of direction setting switches has been turned on in a predetermined operation direction out of the multiple operation directions.

According to the present disclosure, the operator is likely to obtain the clear sensation of turning on of the switch in the desired direction.

DESCRIPTION OF THE PREFERRED EMBODIMENTS

A multi-directional input device according to an embodiment will be described below with reference to the accompanying drawings. In the description and drawings, elements that are substantially the same may be denoted by the same reference signs so as to omit redundant description.

Embodiment

Overall Structure

Figure 1:
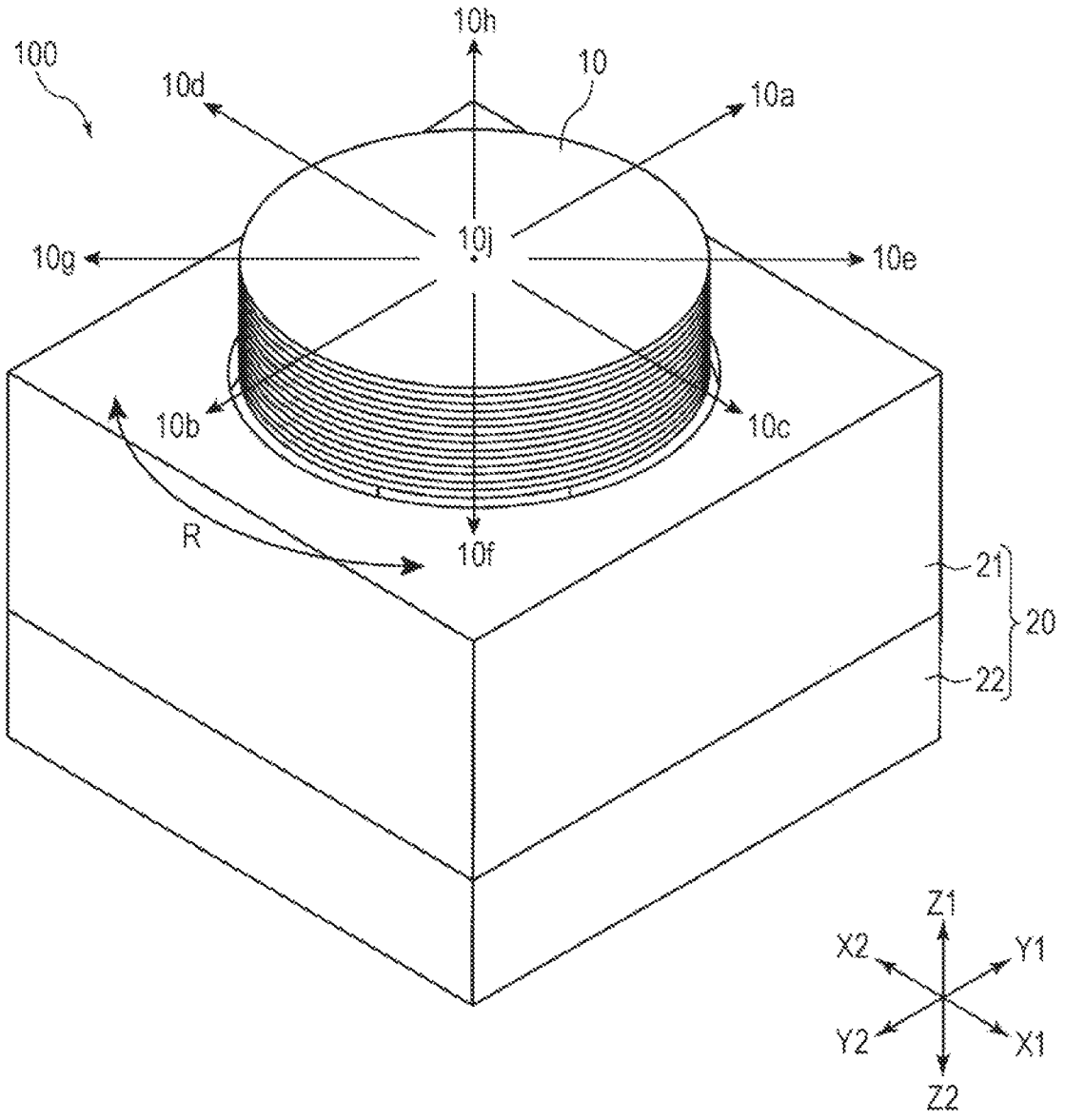
FIG. 1 is an external perspective view of an example of a multi-directional input device according to an embodiment.

First, an overall structure and examples of use of a multi-directional input device according to an embodiment are described with reference to FIG. 1. FIG. 1 is an external perspective view of the multi-directional input device according to the embodiment. FIG. 1 illustrates, as an example, an operation knob 10 that can undergo sliding operation in eight sliding operation directions 10*a* to 10*h* and is rotatable. The eight sliding operation directions are radial directions that are spaced from each other by 45 degrees and centered at a rotation center 10*j* of the operation knob 10 having a circular shape in plan view. Referring to FIG. 1, sides of a bottom surface of a substantially box-shaped housing 20 extend along an X1-X2 direction (X direction or X axis) or a Y1-Y2 direction (Y direction or Y axis), and a Z1-Z2 direction (Z direction or Z axis) is perpendicular to a plane defined by the X axis and the Y axis. The Z axis may be parallel to the direction of gravity or parallel to a direction other than the direction of gravity depending on a state of installation of a multi-directional input device 100. The sliding operation directions 10*a*, 10*b*, 10*c*, 10*d* are respectively parallel to a Y1 direction, Y2 direction, an X1, direction, and an X2 direction. The sliding operation directions 10*e*, 10*f*, 10*g*, 10*h* are respectively parallel to central angles of the X1-Y1, X1-Y2, X2-Y2, X2-Y1.

Figure 15:
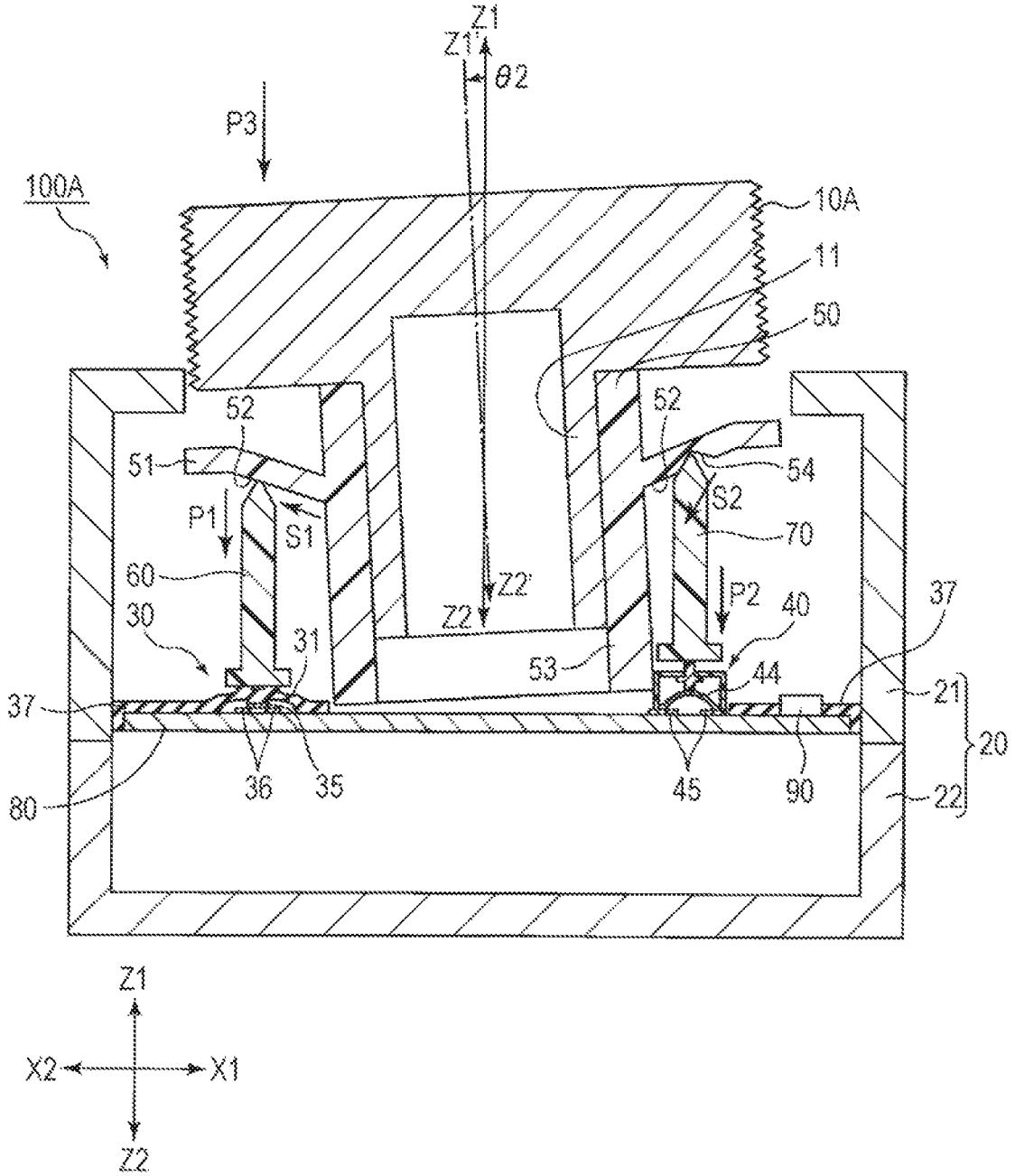
FIG. 15 is an explanatory view illustrating operation manners of elements of the multi-directional input device when a variation of the operation knob undergoes inclination operation in a predetermined operation direction.
Figure 16:
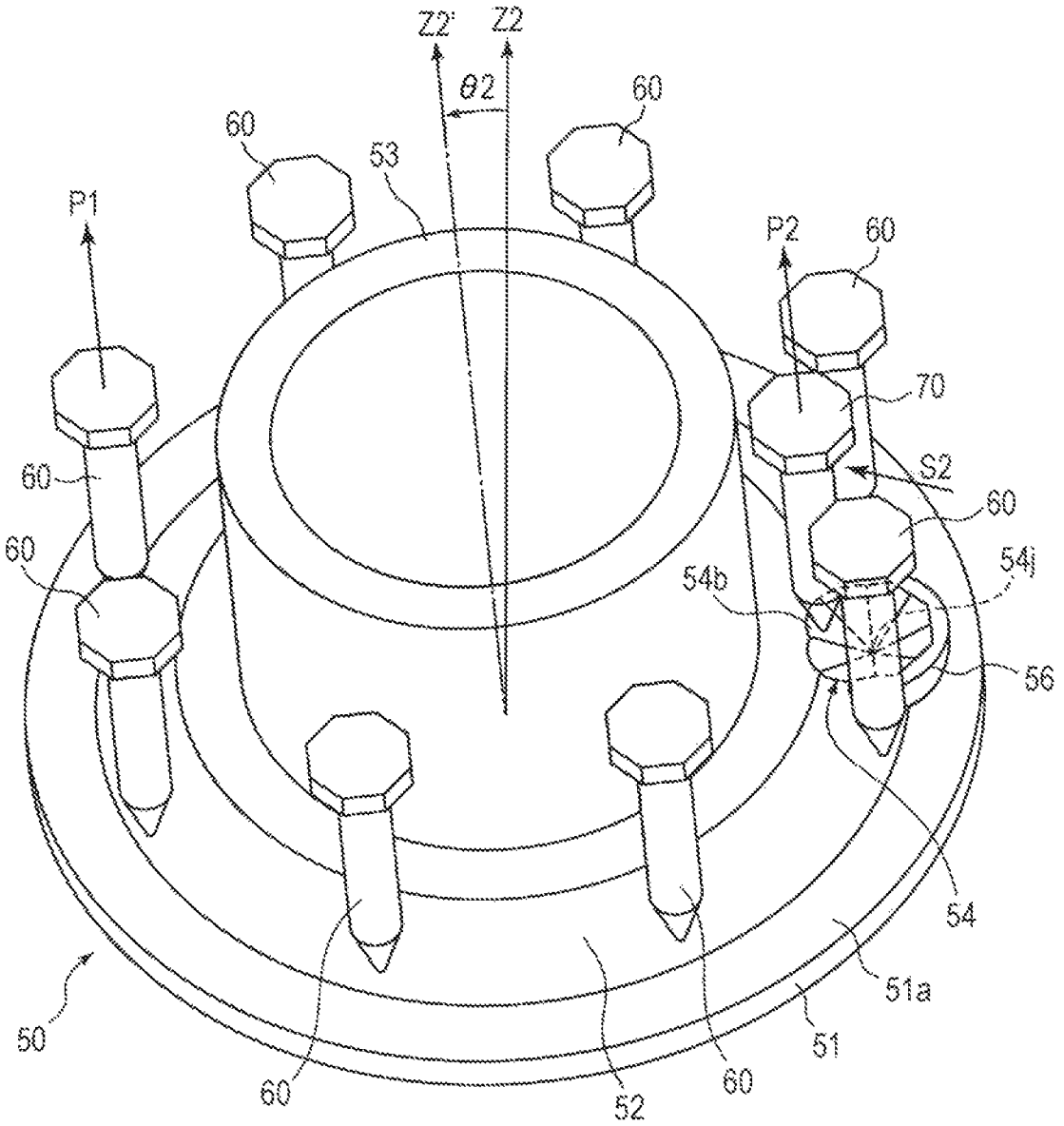
FIG. 16 is a perspective view illustrating the operation manners of the inclination plate, the first pressing member, and the second pressing member during the inclination operation illustrated in FIG. 15 when the inclination plate is seen from obliquely below.

Although "operation" of the operation knob 10 refers to, for example, sliding of the operation knob 10 in the X-Y plane defined by the X axis and Y axis with the operation knob 10 extending in a Z-axis direction held in the Z-axis direction herein, the "operation" also refers to inclination of the operation knob 10 as illustrated in FIGS. 15 and 16. Hereafter, the multi-directional input device 100 illustrated in FIGS. 1 to 13 is a device that includes the operation knob 10 to be subjected to sliding operation, and a multi-directional input device 100A illustrated in FIGS. 15 and 16 is a device that includes an operation knob 10A to be subjected to inclination operation.

Although the multi-directional input device 100 illustrated in FIG. 1 is preferably applied to a vehicle such as an automobile, the multi-directional input device 100 may be applied to any of aircraft, railroad, a ship, and so forth, and further, a controller of a game machine or the like. When the multi-directional input device 100 is mounted in an automobile, the multi-directional input device 100 can be installed in an instrument panel or the like instead of in a center console beside a driver's seat or in a steering wheel.

The multi-directional input device 100 includes the housing 20 and the operation knob 10 that projects in the Z1 direction from an upper surface of the housing 20. The housing 20 is formed by connecting two halves 21, 22 to each other by bonding, welding, using bolts, or the like. The housing 20 can be formed of a material that has a high electrical insulation and further, a good mechanical workability. For example, the housing 20 is formed by injection molding a resin material such as acrylonitrile butadiene styrene (ABS) resin or polycarbonate, or performing aluminum die casting or the like on an aluminum alloy or the like.

The operation knob 10 has many incisions that extend in a circumferential direction in a cylindrical side surface thereof. This allows an operator to grasp the side surface of the operation knob 10 so as to rotate the operation knob 10 in R directions being a clockwise and counterclockwise directions about the rotation center 10*j* of the operation knob 10. In so doing, the operation knob 10 serves as a rotation knob, and the incisions in the side surface have a non-slip function when the operation knob 10 is held between fingers of a hand for the rotation.

The operation knob 10 can undergo sliding operation in eight directions in addition to being rotatable by operation about the rotation center 10*j*. As described above, the illustrated multi-directional input device 100 is a device that includes the operation knob 10 able to undergo sliding operation in eight directions, and the term "multi-directional" refers to the eight directions. Although the multi-directional input device 100 of the illustrated example is a device in which the operation knob 10 undergoes sliding operation in eight directions, "multi-directional" also refers to operation directions the numbers of which are smaller than eight such as two, four, and six and greater than eight such as ten and twelve. Thus, the multi-directional input device 100 may be a multi-directional input device the number of the operation directions of which may be other than eight.

An example of use of the multi-directional input device 100 is described. For example, switches such as a navigation switch, an audio switch, and a home switch which are not illustrated are disposed at positions above/below or to the left/right of the operation knob 10 on the upper surface of the housing 20. When the operator selects and presses down desired one of the switches, an image for selected content is displayed on a liquid crystal display or the like disposed in a front surface of the steering wheel. In a form of a head-up display in a windshield area, information on the selected content is displayed in the head-up display displayed as above.

When the operator selects, for example, the navigation switch, navigation information is displayed on the display. The navigation information includes various selection switches such as map information display switch including a present location and a destination search switch. When the operator determines a required selection switch from the various selection switches related to the navigation information displayed on the display, the operation knob 10 may be rotated so as to scroll a determined switch on the screen. However, to reach a target selection switch more quickly, sliding operation in eight directions of the operation knob 10 can be utilized.

As illustrated in FIG. 1, when the operator performs sliding operation on the operation knob 10 in a desired predetermined operation direction out of eight directions, a determination switch can be quickly moved in a direction of sliding operation on the display. This is an example of forms of use of the multi-directional input device 100. Also in the automobile, use for power windows and other various examples of use of the multi-directional input device 100 exist. When the multi-directional input device 100 is mounted in a device not used for a vehicle, examples of use exist depending on a device in which the multi-directional input device 100 is mounted.

Inner Structure of Multi-Directional Input Device

Figure 2:
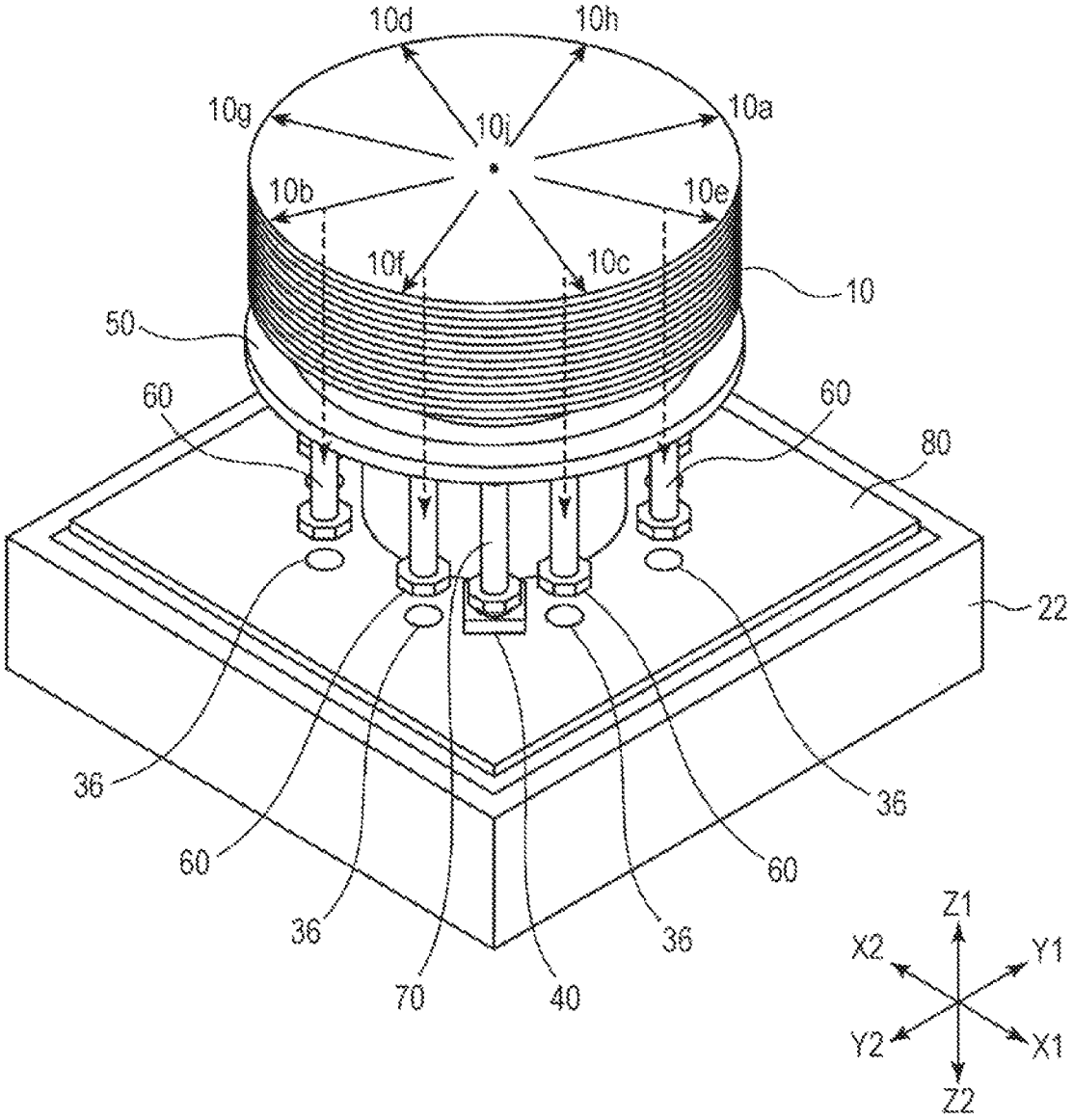
FIG. 2 is a perspective view when an inside of the multi-directional input device is viewed with an upper half of a housing and a rubber sheet removed.
Figure 3:
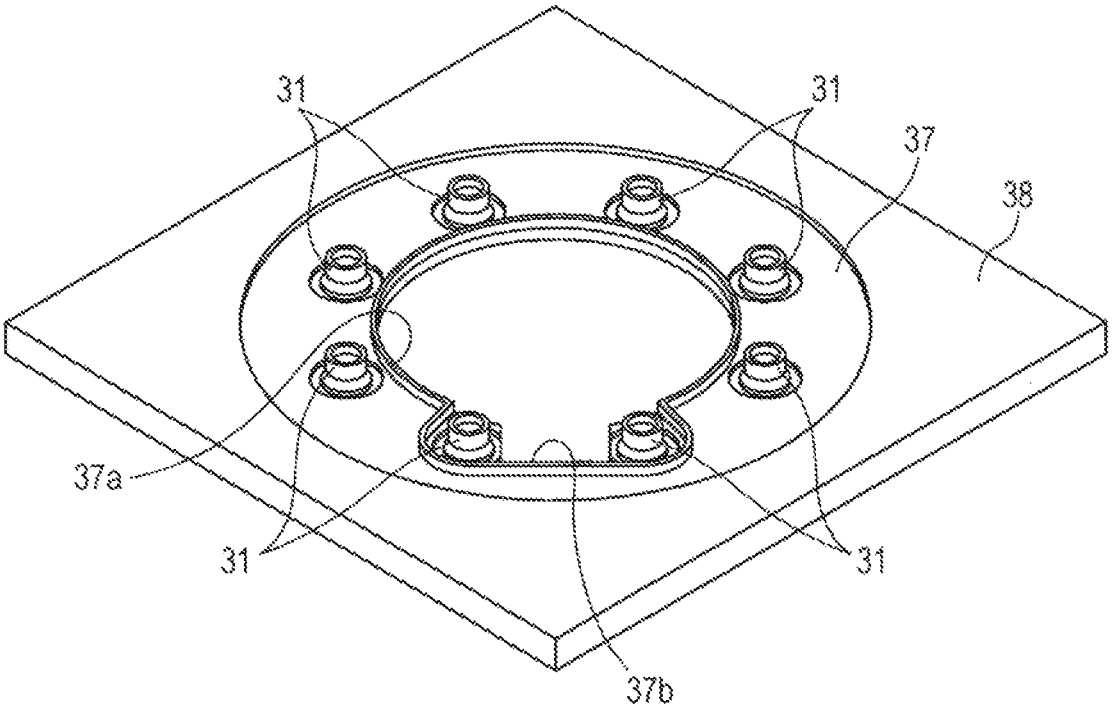
FIG. 3 is a perspective view of an example of the rubber sheet.

Next, an inner structure of the multi-directional input device according to the embodiment is described with reference to FIGS. 2 to 11. Here, FIG. 2 is a perspective view when the inside of the multi-directional input device is viewed with an upper half of the housing and a rubber sheet removed. FIG. 5 is a perspective view illustrating a state in which the rubber sheet illustrated in FIG. 3 is attached to a structure illustrated in perspective view of FIG. 2. FIG. 12, which illustrates operation manners of elements of the multi-directional input device when the operation knob undergoes sliding operation in a predetermined operation direction, will be referred to on a case-by-case basis.

As illustrated in FIG. 2, preferably, an inclination plate 50 having a substantially cylindrical shape is disposed below the operation knob 10. More specifically, as illustrated in FIG. 12, the operation knob 10 and the inclination plate 50 are integrated with each other when a cylindrical portion 11 on the lower side of the operation knob 10 is fitted into a cylindrical portion 53 of the inclination plate 50.

As will be described in detail later, preferably, a first cam formed by an inclined surface having a truncated conical shape is provided on the lower side of the inclination plate 50. Preferably, eight first pressing members 60 are disposed so as to be spaced from each other by 45 degrees in the circumferential direction at positions corresponding to eight sliding operation directions of the operation knob 10. For example, when the number of the sliding operation directions is four, four first pressing members 60 are disposed so as to be spaced from each other by 90 degrees in the circumferential direction.

In FIG. 2, the first pressing members 60 corresponding to the sliding operation directions 10*b*, 10*c*, 10*e*, 10*f* are indicated by arrows. The first pressing members 60 are formed by, for example, injection molding a resin material such as polyethylene or polypropylene having mechanical toughness.

A second pressing member 70 is disposed between two of the first pressing members 60 out of eight first pressing members 60 arranged so as to be spaced from each other by 45 degrees in the circumferential direction below the inclination plate 50. In FIG. 2, the second pressing member 70 is disposed between the first pressing members 60 corresponding to the sliding operation directions 10*c*, 10*f* of the operation knob 10. Similarly to the first pressing members 60, the second pressing member 70 is formed by injection molding a resin material such as polyethylene or polypropylene.

All the first pressing members 60 and the second pressing member 70 are disposed such that longitudinal directions thereof extend in the Z-axis direction. Furthermore, the first pressing members 60 and the second pressing member 70 have large width portions at lower ends thereof so as to be able to reliably press rubber domes 31 (see FIG. 3) included in rubber dome switches 30 (exemplifying direction setting switches) and a metal dome switch 40 (exemplifying a sensation generation unit) illustrated in FIG. 2 disposed below the first pressing members 60 and the second pressing member 70. Referring to FIG. 2, orientations of the first pressing members 60 and the second pressing member 70 are maintained so as not to fall and so as to be movable upward and downward by an inner structure of the upper half 21 of the housing 20 included in the multi-directional input device 100. For example, FIG. 2 illustrates the first pressing members 60 and the second pressing member 70 in a state in which the orientations thereof are maintained by the inner structure of the half 21 (not illustrated).

As illustrated in FIG. 2, a wiring board 80 that exists in a plane formed by the X axis and the Y axis and that has a rectangular shape in plan view is disposed below the first pressing members 60 and the second pressing member 70. The wiring board 80 is placed on a placement portion (not illustrated) in the lower half 22. A wiring pattern formed on the surface of the wiring board 80 is omitted from FIG. 2.

As illustrated in FIG. 2, eight first fixed contacts 36 respectively included in eight rubber dome switches 30 are provided at positions of the wiring board 80 corresponding to eight first pressing members 60. In FIG. 2, four of the first fixed contacts 36 are clearly illustrated. The first fixed contacts 36 are formed of, for example, copper foil or the like, and the surface of the copper foil is gold plated.

Figure 4:
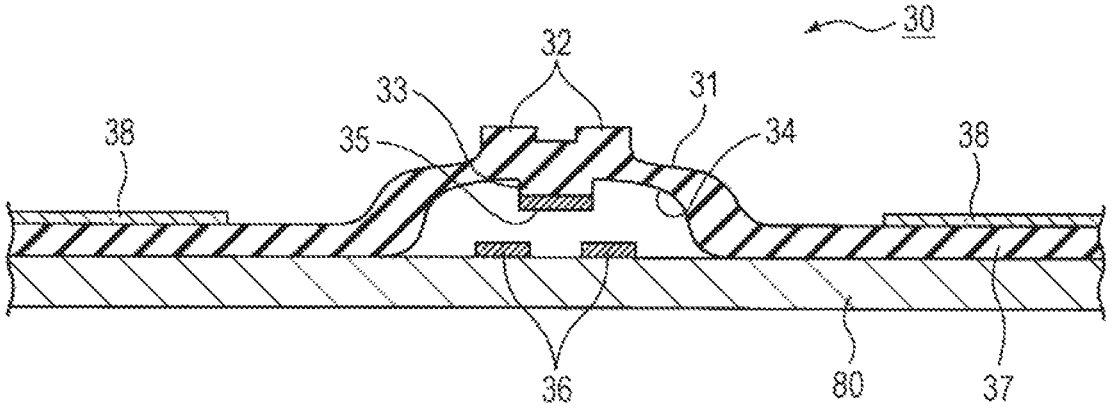
FIG. 4 is a longitudinal sectional view of an example of a rubber dome switch.
Figure 5:
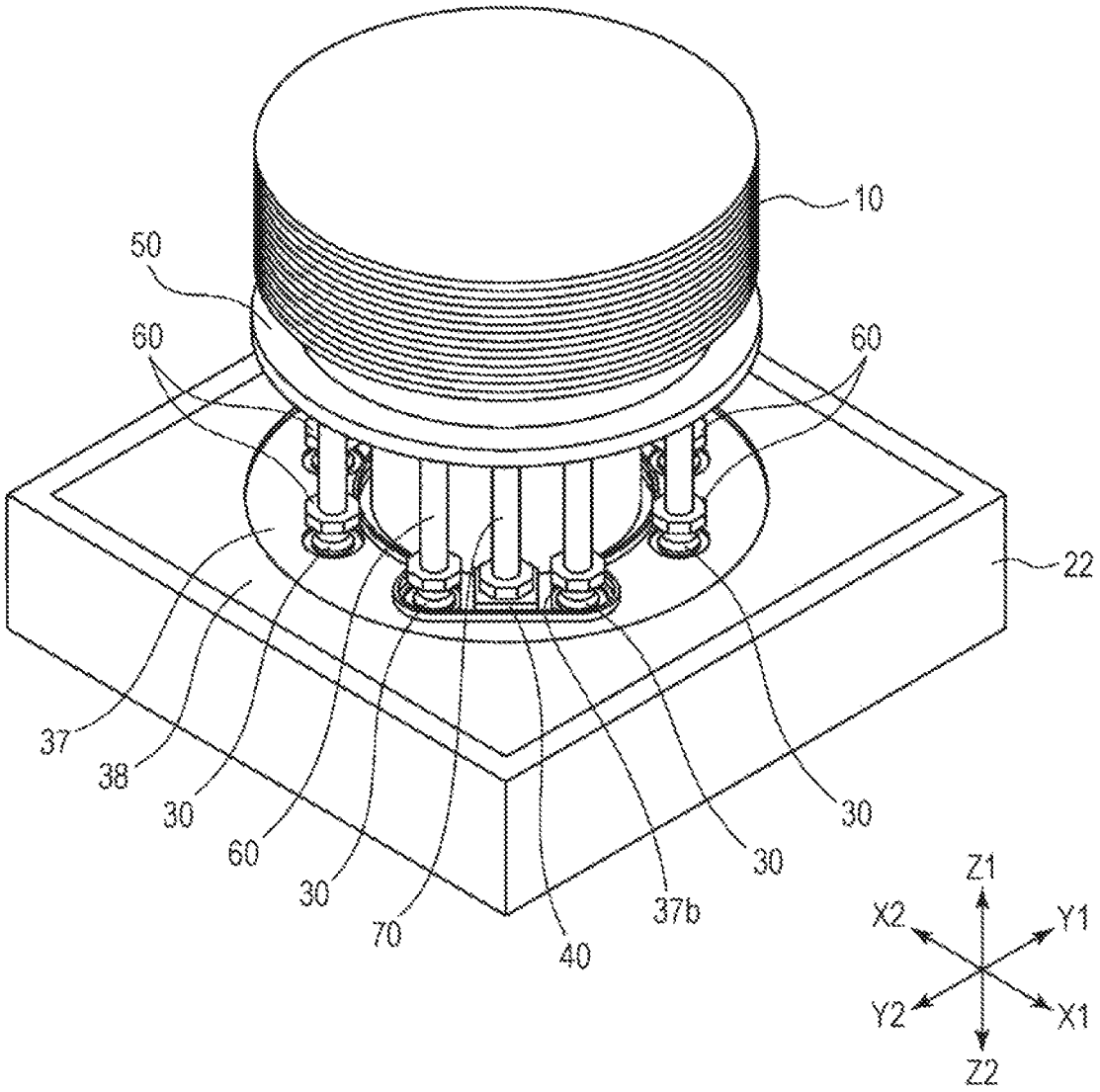
FIG. 5 is a perspective view illustrating a state in which the rubber sheet illustrated in FIG. 3 is attached to a structure illustrated in perspective view of FIG. 2.
Figure 6:
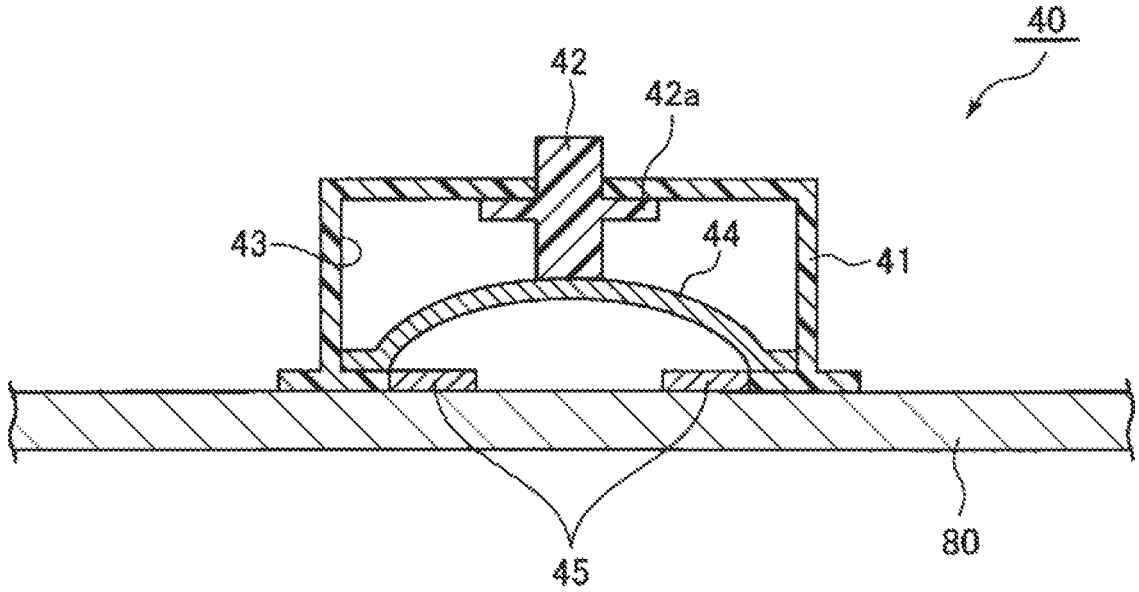
FIG. 6 is a longitudinal sectional view of an example of a metal dome switch.

Here, with reference to FIGS. 3 and 4, the rubber dome switches exemplifying the direction setting switches are described. In FIG. 4, a rubber sheet 37 is illustrated together with the wiring board 80. As illustrated in FIG. 3, the rubber sheet 37 that has a rectangular shape (including a square shape) and that has a shape complementary to a planar shape of the wiring board 80 has an annular opening 32*a* at the center thereof, and a small opening 37*b* having a rectangular shape in plan view communicates with part of the annular opening 32*a*. In the rubber sheet 37, eight rubber domes 31 are provided along an outer circumference of the annular opening 32*a* so as to be spaced from each other by 45 degrees, and an outer circumference of the rubber domes 31 in the rubber sheet 37 is coated with a waterproof sheet 38.

The rubber sheet 37 provided with the rubber domes 31 is formed of an elastic material such as silicone rubber that is highly weatherproof and highly electrically insulative against, for example, arc discharge. When the rubber sheet 37 is formed of an elastic material such as silicone rubber, the rubber sheet 37 can be easily attached to the wiring board 80 while being appropriately deformed.

As illustrated in FIG. 4, preferably, each of the rubber dome switches 30 exemplifying the direction setting switch includes a rubber dome 31, a first movable contact 35, and a pair of first fixed contacts 36. The first movable contact 35 is attached in a dome interior space 34 of the rubber dome 31. The pair of first fixed contacts 36 are electrically connected to the wiring pattern of the wiring board 80 in the wiring board 80. In FIG. 4, the first movable contact 35 and the pair of first fixed contacts 36 are separated from each other, and the rubber dome switch 30 is in an off state.

The rubber dome 31 is continuous with the rubber sheet 37 and, as is the case with the illustrated example, bulges upward to have a substantially trapezoidal shape or a substantially semispherical shape, thereby forming the dome interior space 34. A first pusher 32 that projects upward is provided at an upper end of the rubber dome 31, and a second pusher 33 that projects into the dome interior space 34 below the second pusher 33 is provided at a lower end of the rubber dome 31. The first movable contact 35 is attached to the lower end of the second pusher 33.

The first movable contact 35 and the first fixed contacts 36 are formed of, for example, phosphor bronze or the like, and the surface of the phosphor bronze is gold plated. Since the first movable contact 35 and the first fixed contacts 36 are gold plated, the weatherproofness of the first movable contact 35 and the first fixed contacts 36 is improved and contact resistance between the first movable contact 35 and the first fixed contacts 36 is reduced. Furthermore, this can suppress an increase in contact resistance caused due to a film that would otherwise be formed by arc discharge able to be generated when the first movable contact 35 and the first fixed contacts 36 are brought into contact with each other.

When one of the first pressing members 60 disposed above the rubber dome 31 is pressed down so as to press the first pusher 32 downward, the rubber dome 31 is elastically deformed downward so as to bring the first movable contact 35 into contact with the pair of first fixed contacts 36. Thus, the first fixed contacts 36 and the first movable contact 35 are configured such that the first fixed contacts 36 and the first movable contact 35 can be brought into contact with or separated from each other. Bringing the first movable contact 35 into contact with the pair of first fixed contacts 36 allows electrical conduction between the pair of the first fixed contacts 36, thereby setting the rubber dome switch 30 in an on state. As will be described in detail later, an on signal of the rubber dome switch 30 is transmitted to a controller 90 (see FIG. 12) that is provided in the wiring board 80 and electrically connected to the rubber dome switch 30 via the wiring pattern.

The operation knob 10 is urged toward the rotation center 10*j* (see FIG. 1) illustrated in FIG. 1 by a restoring force of the rubber dome 31 transmitted via the first pressing member 60. When the operator removes the finger of the hands from the operation knob 10 after the rubber dome switch 30 has been turned on and further, as will be described in detail later, the metal dome switch 40 has been turned on, the rubber dome 31 is released from a pressed state by the first pressing member 60 pressed down by a first cam 52. The rubber dome 31 formed of an elastic member performs self-restoration to the original state illustrated in FIG. 4 due to elastic deformation of the rubber dome 31 when the rubber dome 31 is released from the pressed state. The first pressing member 60 is pressed upward by the restoring force due to the self-restoration of the rubber dome 31, and the first cam 52 is pressed upward when the first pressing member 60 is pressed upward. Consequently, the operation knob 10 is returned to the center 10*j* illustrated in FIG. 1.

FIG. 5 illustrates a state in which the rubber sheet 37 is disposed on the surface of the wiring board 80. The rubber domes 31 of the rubber sheet 37 and the rubber dome switches 30 including the rubber domes 31 are disposed below eight first pressing members 60. In FIG. 5, the metal dome switch 40 exemplifying the sensation generation unit is disposed between two of the rubber dome switches 30, and the second pressing member 70 is disposed above the metal dome switch 40. Here, with reference to FIG. 6, the metal dome switch 40 exemplifying the sensation generation unit is described.

Preferably, the metal dome switch 40 includes a pair of second fixed contacts 45, a second movable contact 44, and a pusher 42. The pair of second fixed contacts 45 are electrically connected to the wiring pattern of the wiring board 80 in the wiring board 80. The second movable contact 44 surrounds the pair of second fixed contacts 45 and has a dome shape. The pusher 42 presses the second movable contact 44. The second fixed contacts 45 and the second movable contact 44 are accommodated in a casing interior space 43 of a casing 41, and the pusher 42 is attached through a top end opening of the casing 41 so as to be movable upward and downward. The pusher 42 has an engagement flange 42*a* disposed partway along the pusher 42. This engagement flange 42*a* is engageable with a lower surface of a top end of the casing 41, thereby removal of the pusher 42 from the casing 41 is suppressed.

When the second pressing member 70 disposed above the metal dome switch 40 is pressed down so as to press the pusher 42 downward, the dome-shaped second movable contact 44 is elastically deformed downward so as to be brought into contact with the pair of second fixed contacts 45. Thus, the second fixed contacts 45 and the second movable contact 44 are configured such that the second fixed contacts 45 and the second movable contact 44 can be brought into contact with or separated from each other. Bringing the second movable contact 44 into contact with the pair of second fixed contacts 45 allows electrical conduction between the pair of the second fixed contacts 45, thereby setting the metal dome switch 40 in an on state. As will be described in detail later, similarly to the on signal of the rubber dome switch 30, an on signal of the metal dome switch 40 is also transmitted to the controller 90 (see FIG. 12) that is provided in the wiring board 80 and electrically connected to the metal dome switch 40 via the wiring pattern.

Similarly to the first movable contact 35 and the first fixed contacts 36, the second fixed contacts 45 are formed of, for example, phosphor bronze or the like, and the surface of the phosphor bronze is gold plated. A disc spring formed of stainless steel or the like is applied to the second movable contact 44. The casing 41 and the pusher 42 are formed of a resin material such as polyethylene or polypropylene.

In the multi-directional input device 100, when the operator performs the sliding operation on the operation knob 10 in a desired predetermined sliding operation direction, first, at least one rubber dome switch 30 out of the plurality of rubber dome switches 30 corresponding to the sliding operation direction is turned on. Here, "at least one rubber dome switch 30 . . . is turned on" refers to cases including a case where two or more of the rubber dome switches 30 are successively turned on in addition to a case where one of rubber dome switches 30 is turned on. For example, referring to FIG. 1, when the operation knob 10 is operated in the sliding operation direction 10*e*, which is the direction of the central angle (45 degrees) of X1-Y1, the rubber dome switch 30 corresponding to the sliding operation direction 10*e* is turned on, and then, in some cases, the rubber dome switches 30 respectively corresponding to the sliding operation directions 10*a*, 10*c* at the sides of the rubber dome switch 30 corresponding to the sliding operation direction 10*e* are successively turned on, following the rubber dome switch 30 corresponding to the sliding operation direction 10*e*. In this case, on signals of the rubber dome switches 30 corresponding to the respective sliding operation directions 10*e*, 10*a*, 10*c* are sequentially transmitted to the controller 90 in order of turning on of the rubber dome switches 30. The controller 90 is configured such that, when a plurality of on signals are transmitted as described above, the controller 90 determines as the operation direction the sliding operation direction (sliding operation direction 10*e* herein) corresponding to the on signal transmitted first. Thus, even when a plurality of the rubber dome switches 30 are successively turned on, the operation direction that the operator intends is appropriately determined by the controller 90. After the rubber dome switches 30 have been turned on, and when the metal dome switch 40 is turned on, an input operation for the operation direction is completed. As described above, the multi-directional input device 100 includes a double-action switch. The rubber dome switches 30 are formed of an elastic material such as silicone rubber. Thus, a load value for pressing the rubber dome switches 30 is small, and a load variation amount for pressing the rubber dome switches 30 is small. Accordingly, when the rubber dome switches 30 are turned on, the operator is unlikely to feel a tactile response. In contrast, the metal dome switch 40 is formed of a disc spring of stainless steel or the like. Thus, preferably, a load value and the load variation amount for pressing the metal dome switch 40 increase compared to those for pressing the rubber dome switches 30. Accordingly, the operator who does not feel a tactile response when the rubber dome switches 30 are turned on can feel a clear tactile response when the metal dome switch 40 is turned on.

Figure 7:
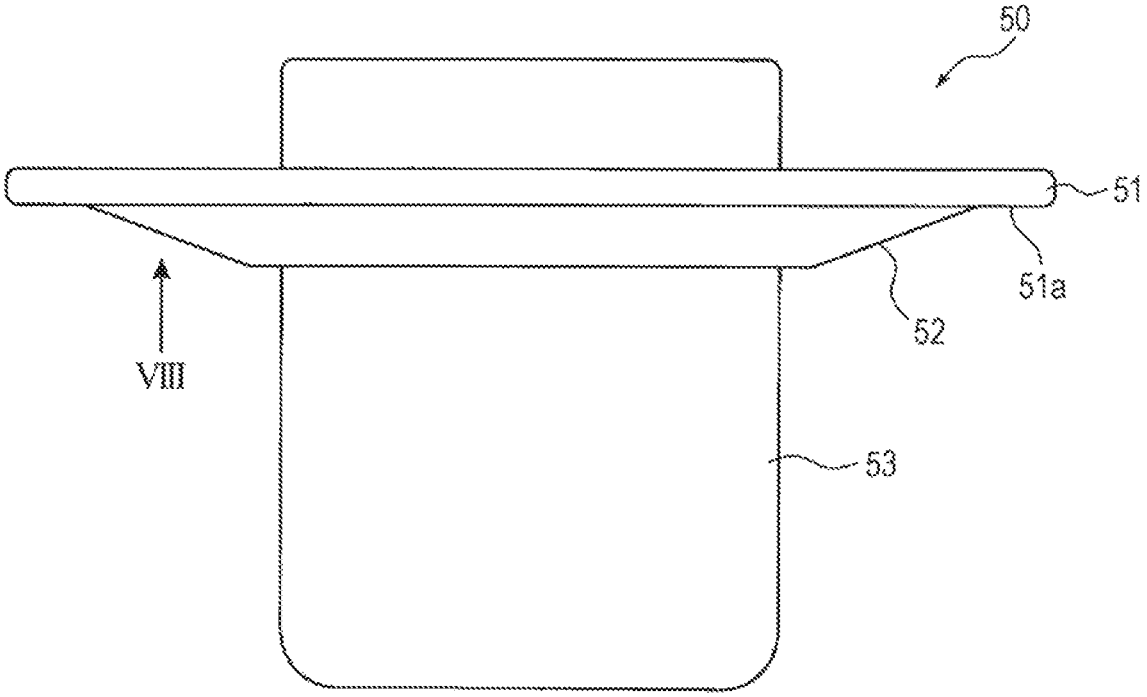
FIG. 7 is a side view of an example of an inclination plate having a first cam.
Figure 8A:
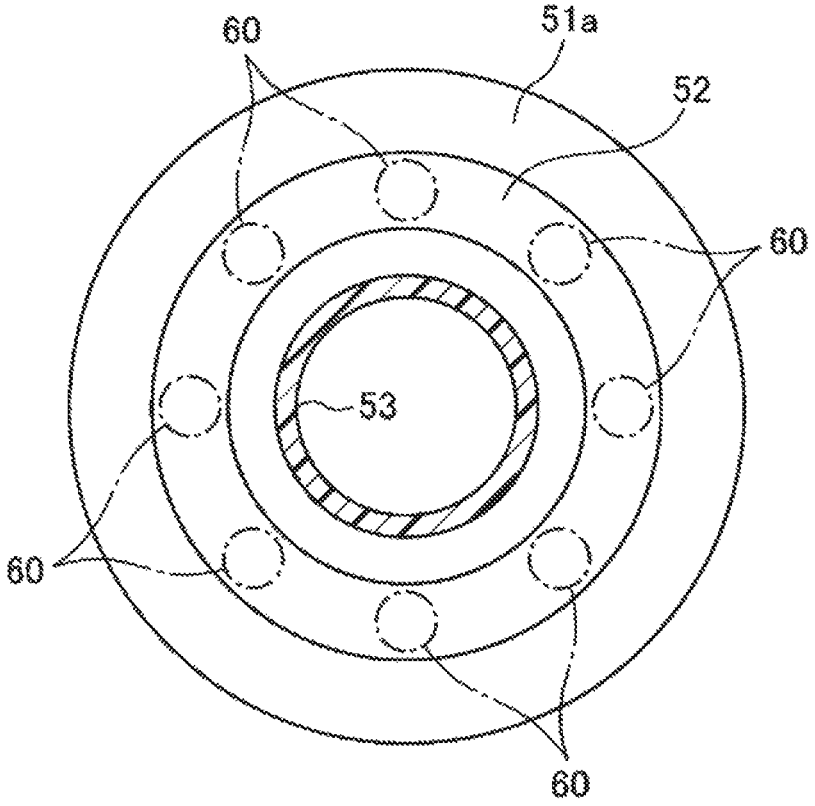
FIG. 8A illustrates a structure illustrated in FIG. 7 seen in an arrow in an VIII-direction.
Figure 8B:
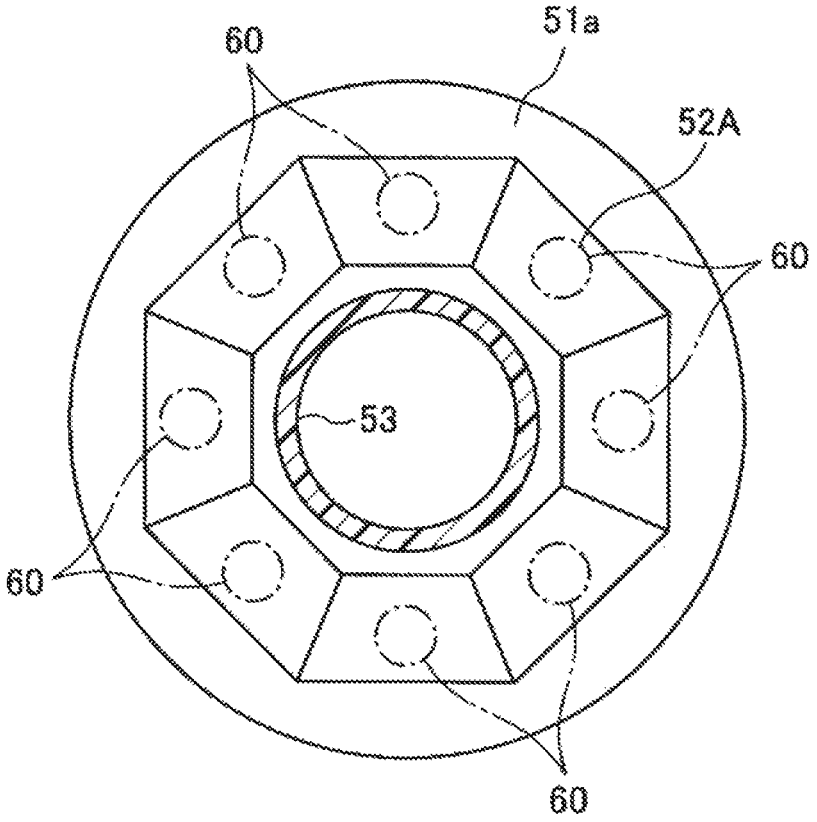
FIG. 8B corresponds to FIG. 8A, illustrating a variation of the inclination plate.
Figure 9:
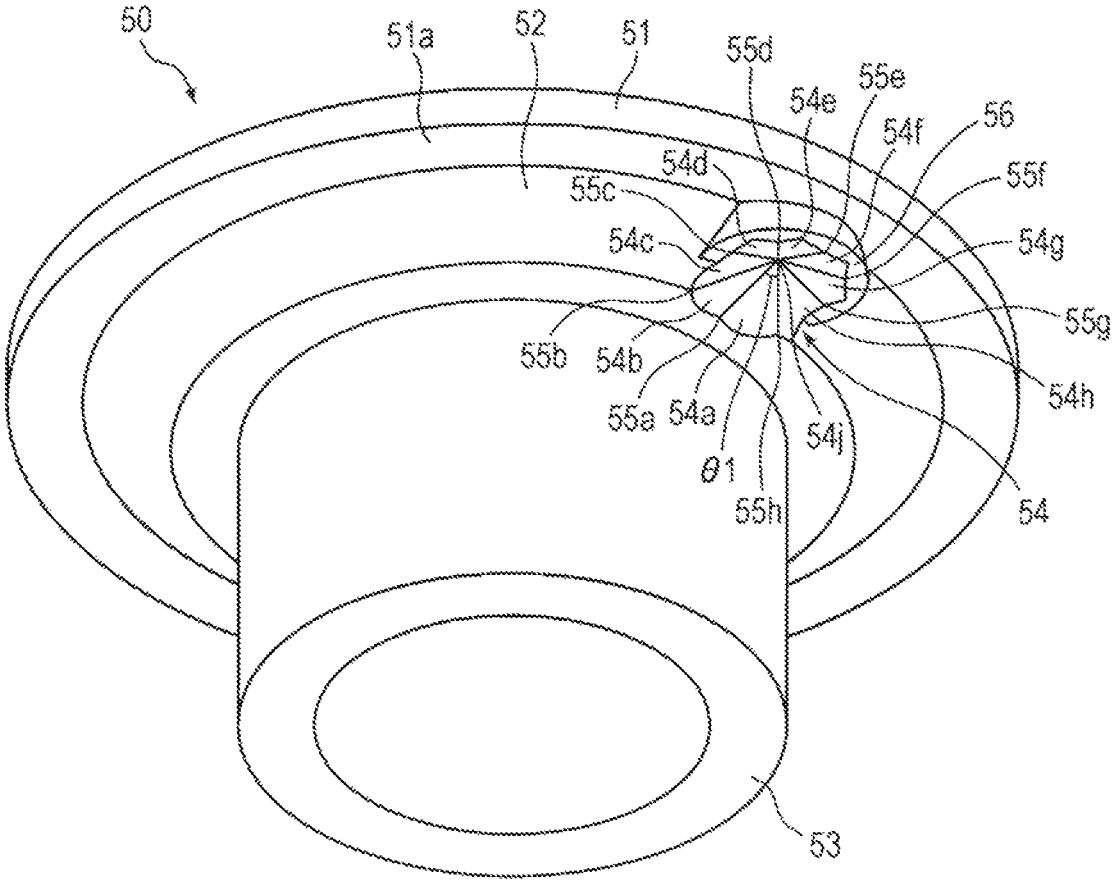
FIG. 9 is a perspective view of the inclination plate seen from obliquely below.
Figure 10:
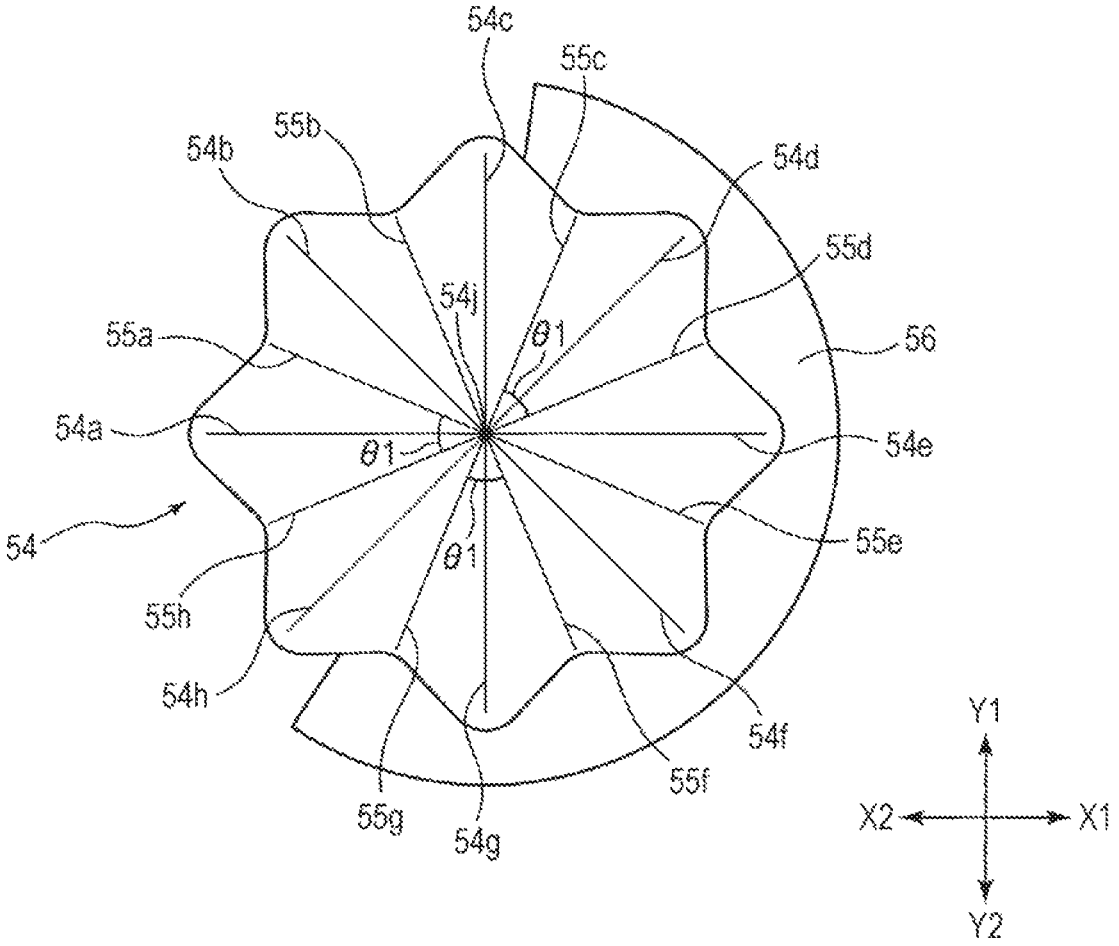
FIG. 10 is a front view of an example of a second cam.
Figure 11:
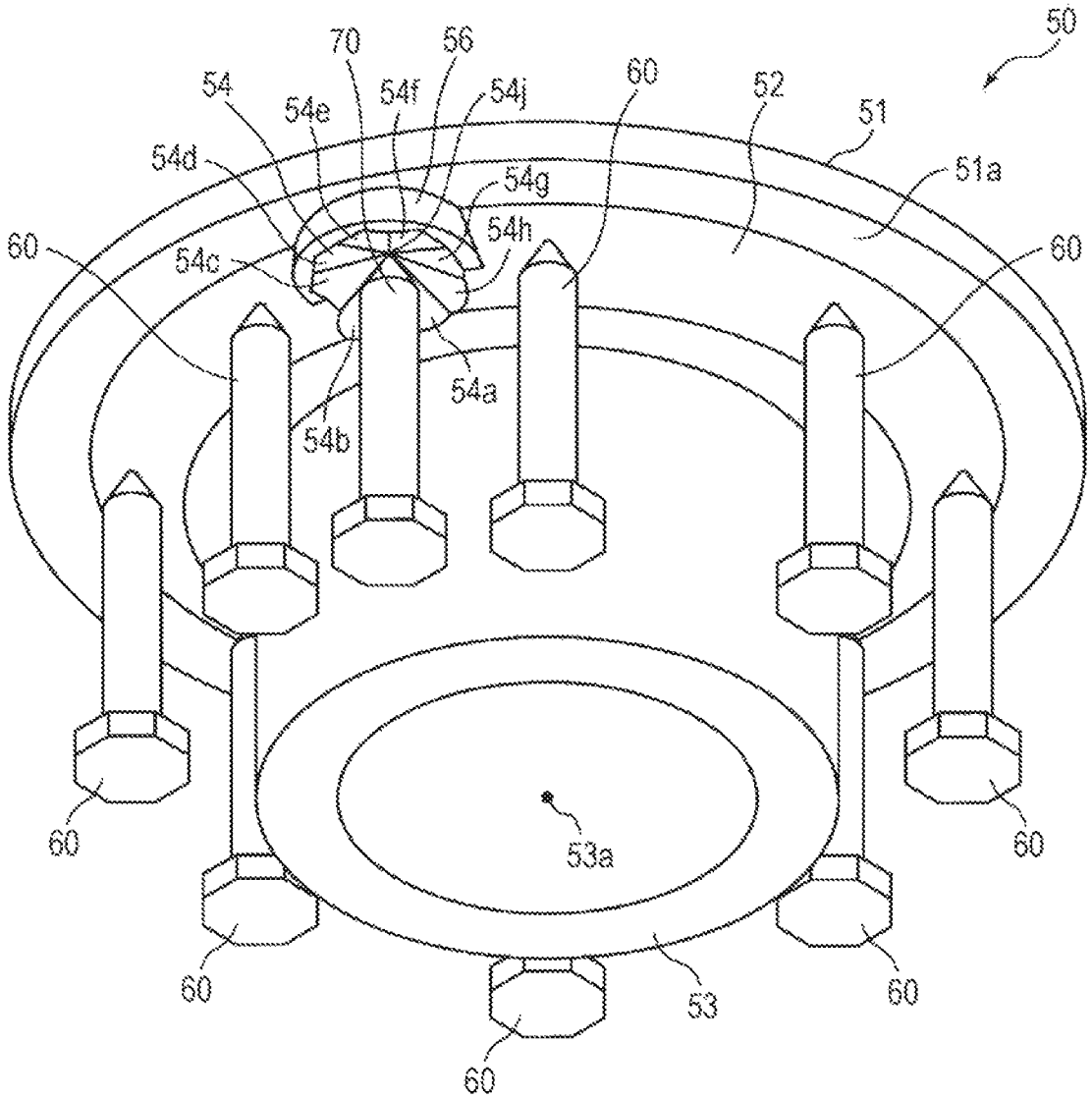
FIG. 11 is a perspective view of a state in which first pressing members and a second pressing member are disposed on a lower surface of the inclination plate seen from obliquely below.
Figure 12:
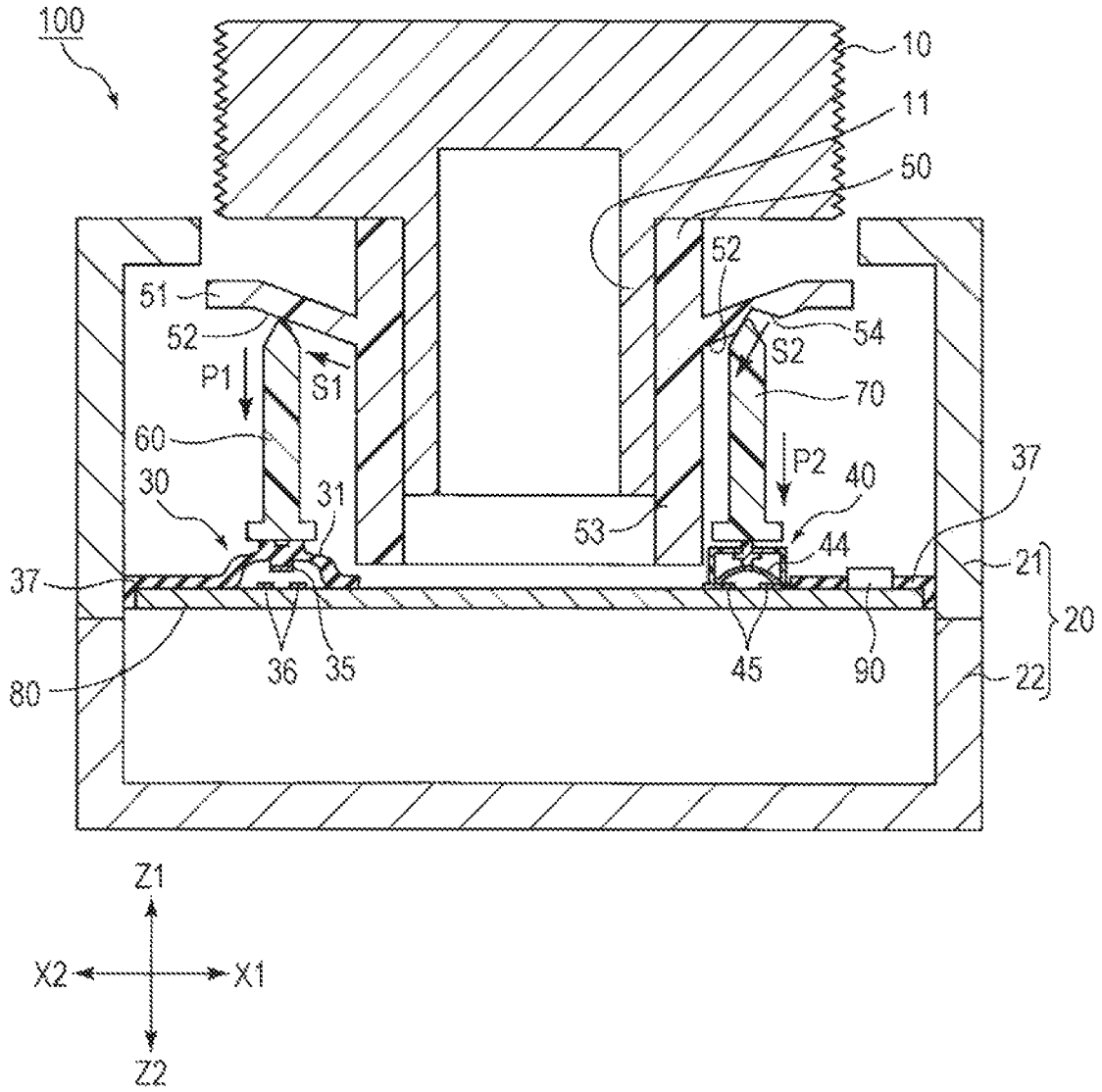
FIG. 12 is an explanatory view illustrating operation manners of elements of the multi-directional input device when an operation knob undergoes sliding operation in a predetermined operation direction.

Next, with reference to FIGS. 7 to 11, the structure of the inclination plate directly pressed by the operation knob 10 is described. Here, FIG. 7 is a side view of an example of the inclination plate having a first cam. FIG. 8A illustrates a structure illustrated in FIG. 7 seen in an arrow in an VIII-direction. FIG. 9 is a perspective view of the inclination plate seen from obliquely below. FIG. 10 is a front view of an example of a second cam. FIG. 11 is a perspective view of a state in which the first pressing members and the second pressing member are disposed on a lower surface of the inclination plate seen from obliquely below. For ease of description of the first cam 52, a second cam 54 is omitted from FIG. 8A.

As illustrated in FIGS. 7 and 8A, the inclination plate 50 has the cylindrical portion 53 at the center and an annular flange portion 51 that laterally overhangs above the cylindrical portion 53. In addition, the first cam 52, which reduces in diameter downward similarly to a tapered structure in side view of FIG. 7, is provided on a lower surface 51*a* of the annular flange portion 51. More specifically, the first cam 52 has an inclined surface having a truncated conical shape and is disposed on the lower surface 51*a* of the flange portion 51 with a truncated part of the truncated conical shape facing downward. In addition, as indicated by dotted chain lines illustrated in FIG. 8A, eight first pressing members 60 are disposed so as to be spaced from each other by 45 degrees in the first cam 52 having an annular shape in front view.

Here, FIG. 8B illustrates a variation of the first cam 52 illustrated in FIG. 8A. The first cam 52 illustrated in FIG. 8A has a function of pressing downward the first pressing members 60 by using the inclined surface of the first cam 52 in accordance with sliding of the inclination plate 50 in a sliding direction. A first cam 52A illustrated in FIG. 8B is formed such that, instead of annular curved surface of the first cam 52 illustrated in FIG. 8A, the first cam 52 has eight flat inclined surfaces of a truncated octagonal pyramid (exemplifying a truncated pyramid-shaped inclined surface) that press downward the respective first pressing members 60. Accordingly, for example, for the form having four first pressing members 60 spaced from each other by 90 degrees, a first cam having four flat inclined surfaces of a truncated square pyramid is applied. For ease of description of the first cam 52A, the second cam is omitted from FIG. 8B.

As illustrated in FIG. 9, preferably, the inclination plate 50 has the second cam 54 disposed partway along the annular first cam 52. Similarly to the first pressing members 60 or the like, the inclination plate 50 having the first cam 52 and the second cam 54 is formed of a resin material such as polyethylene or polypropylene. As illustrated in FIGS. 9 and 10, the second cam 54 has a plurality of cam grooves 54*a* to 54*h* and a plurality of cam ridges 55*a*. The cam grooves 54*a* to 54*h* extend from a central point 54*j* in the sliding operation directions extending in eight directions (exemplifying multiple directions) so as to be inclined along down slopes. The cam ridges 55*a* to 55*h* are disposed between the cam grooves adjacent to each other. For example, the cam ridge 55*a* is interposed between the cam grooves 54*a*, 54*b*.

As illustrated in FIG. 10, the second cam 54 has a shape similar to petals of a flower that has eight petals in plan view, and an angle θ1 for a single petal (angle between the cam ridges adjacent to each other) is 45 degrees.

As illustrated in FIG. 11, eight first pressing members 60 are disposed below the first cam 52 so as to be spaced from each other by 45 degrees, and disposition directions (disposition directions from a central point 53*a* of the cylindrical portion 53 of the inclination plate 50) of the eight first pressing members 60 respectively correspond to disposition directions of the eight cam grooves 54*a* to 54*h* of the second cam 54.

As illustrated in FIG. 11, when the operation knob 10 is not operated, the second pressing member 70 is positioned at the central point 54*j* of the second cam 54. In the second cam 54, the central point 54*j* is a point of intersection where the cam grooves 54*a* to 54*h* that are upwardly inclined in curved shapes intersect each other at the apex. In a state illustrated in FIG. 11, the second pressing member 70 is fitted into the central point 54*j* of the second cam 54.

When the operator performs sliding operation on the operation knob 10 in one of eight sliding operation directions from the state illustrated in FIG. 11, the first pressing member 60 disposed in the sliding operation direction is pressed downward by the first cam 52 including the inclined surface. Also, the second pressing member 70 is pressed downward along the cam groove extending in the sliding operation direction in the second cam 54.

As illustrated in FIGS. 9 to 11, the second cam 54 has an anti-disengagement wall 56 that extends from the proximity of the second cam groove 54*c* to the proximity of the cam groove 54*h* which are positions corresponding to radially outer side of the first cam 52. The anti-disengagement wall 56 suppresses disengagement of the second pressing member 70 from the second cam 54 when the second pressing member 70 is moved toward the radially outer side of the first cam 52 in the second cam 54.

Switching Functions of Multi-Directional Input Device

Figure 13:
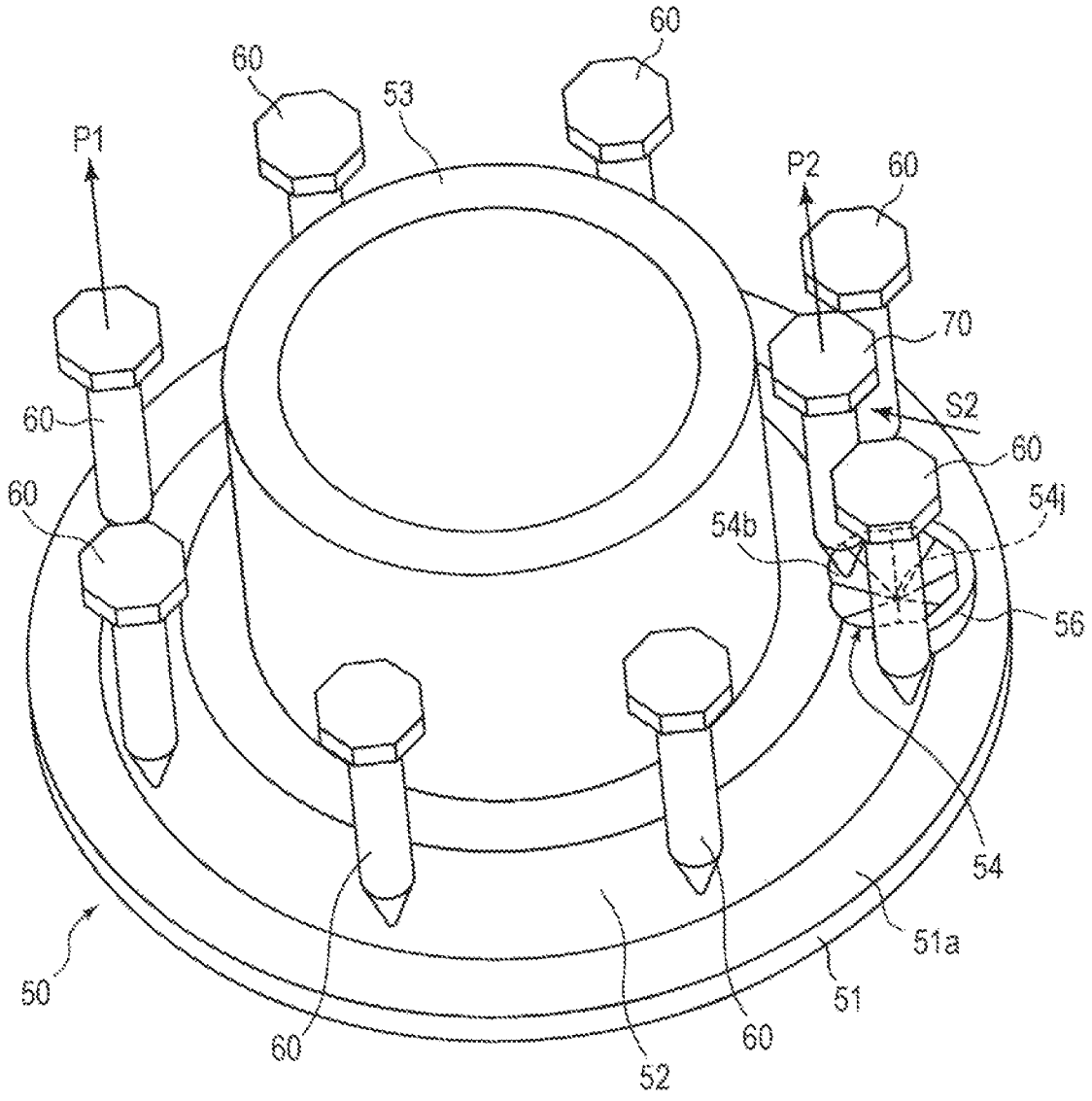
FIG. 13 is a perspective view illustrating the operation manners of the inclination plate, the first pressing member, and the second pressing member during the sliding operation illustrated in FIG. 12 when the inclination plate is seen from obliquely below.
Figure 14:
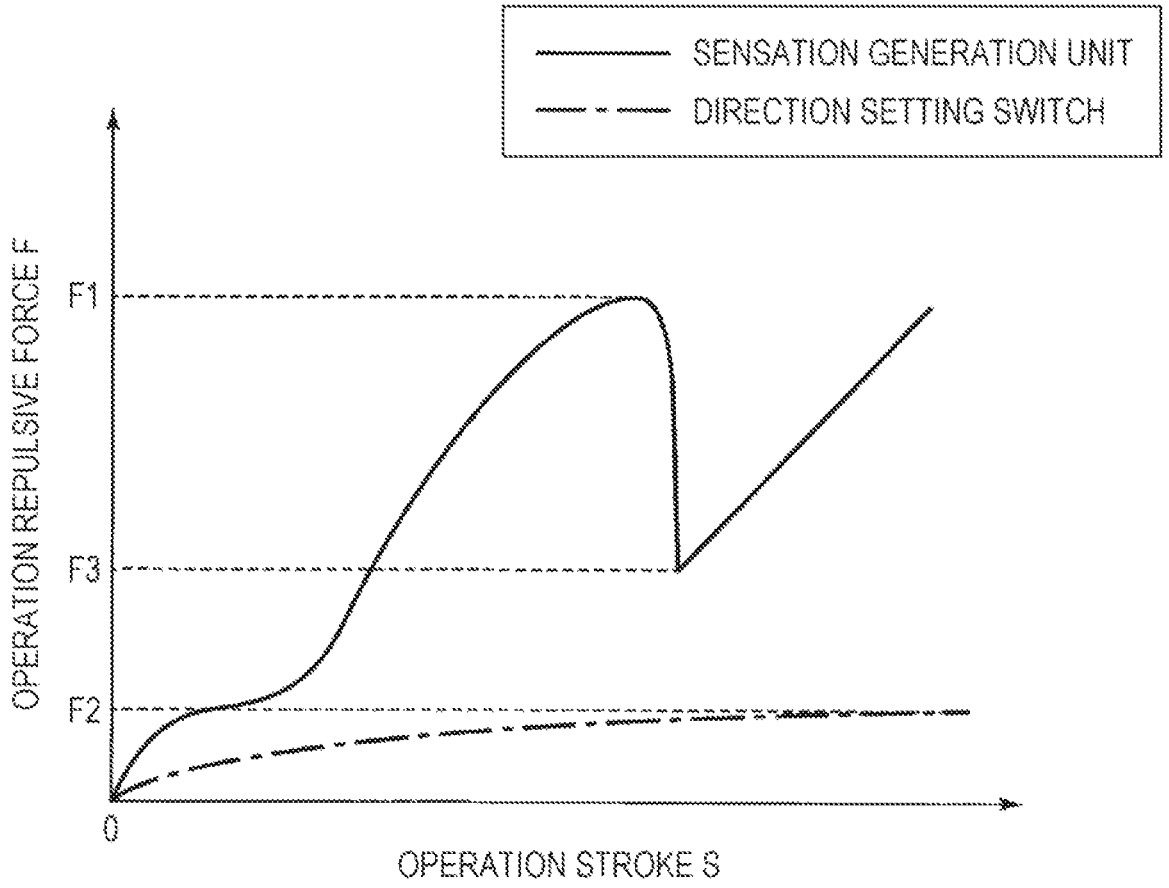
FIG. 14 is a relational graph illustrating an example of the force-stroke (FS) characteristics of a direction setting switch and a sensation generation unit.

Next, switching functions of the multi-directional input device 100 are described with reference to FIGS. 12 to 14. Here, FIG. 12 is an explanatory view illustrating operation manners of the elements of the multi-directional input device when the operation knob undergoes sliding operation in a predetermined operation direction. FIG. 13 is a perspective view illustrating the operation manners of the inclination plate, the first pressing member, and the second pressing member during the sliding operation illustrated in FIG. 12, when the inclination plate is seen from obliquely below. FIG. 14 is a relational graph illustrating an example of the force-stroke (FS) characteristics of the direction setting switch and the sensation generation unit. Here, "FS characteristics" refer to characteristics representing operation feeling felt by the operator during operation by the relationship between an operation stroke (S) and an operation repulsive force (F).

As illustrated in FIG. 12, when the operator performs sliding operation on the operation knob 10 in one of the eight sliding operation directions (sliding operation in the X2 direction in FIG. 12), the first pressing member 60 disposed at a position corresponding to the sliding operation direction is pressed by a pressing force P1 downward in the Z2 direction in accordance with the sliding of a cam surface of the first cam 52 in an S1 direction, and the first pressing member 60 is pressed downward in the Z2 direction. Thus, the rubber dome switch 30 that is disposed below the first pressing member 60 and in the off state is pressed by the first pressing member 60. Consequently, the first movable contact 35 is brought into contact with the pair of first fixed contacts 36 so as to allow electrical conduction between the pair of the first fixed contacts 36. Thus, the rubber dome switch 30 is turned on.

The controller 90 is provided in the wiring board 80. When the rubber dome switch 30 is turned on, the on signal of the rubber dome switch 30 is transmitted to the controller 90 via the wiring pattern (not illustrated).

Meanwhile, also in the second cam 54, when the sliding operation is performed on the operation knob 10, the second pressing member 70 is guided in an S2 direction along the cam groove extending in the sliding operation direction and is pressed by a pressing force P2 downward in the Z2 direction in accordance with the sliding of the cam groove of the second cam 54 in the S2 direction, and the second pressing member 70 is pressed downward in the Z2 direction. Thus, the metal dome switch 40 that is disposed below the second pressing member 70 and in the off state is pressed by the second pressing member 70. Consequently, the second movable contact 44 is brought into contact with the pair of second fixed contacts 45 so as to allow electrical conduction between the pair of the second fixed contacts 45. Thus, the metal dome switch 40 is turned on. When the metal dome switch 40 is turned on, the on signal of the metal dome switch 40 is transmitted to the controller 90 via the wiring pattern (not illustrated). That is, after the first pressing member 60 disposed in the sliding operation direction has been pressed downward by the first cam 52, the second pressing member 70 is pressed downward by the second cam 54 with a short time lag. Thus, after the on signal of the rubber dome switch 30 has been transmitted to the controller 90, the on signal of the metal dome switch 40 is transmitted to the controller 90.

In FIG. 13, only the inclination plate 50, the first pressing members 60, and the second pressing member 70 during the sliding operation illustrated in FIG. 12 are extracted, and the operation manners of these elements are described. When the inclination plate 50 undergoes the sliding operation in a predetermined sliding operation direction, the first pressing member 60 disposed at a position corresponding to the sliding operation direction presses a corresponding one of the rubber dome switches (not illustrated) by the pressing force P1. Also, in a process of sliding of the second pressing member 70 in the S2 direction along the cam groove 54*b* corresponding to this sliding operation direction, the metal dome switch 40 (not illustrated) is pressed by the pressing force P2.

Here, the rubber dome switch 30 exemplifying the direction setting switch is formed of an elastic material such as silicone rubber or the like. Thus, the rubber dome switch 30 is elastically deformed when being pressed, and accordingly, the operator is unlikely to feel sensation (tactile response). Specifically, as illustrated in FIG. 14, the direction setting switch has such FS characteristics that the operation repulsive force hardly increases even when the operation stroke extends and the operation repulsive force is saturated at a very low operation repulsive force F2.

In contrast, the metal dome switch 40 exemplifying the sensation generation unit is formed of a disc spring of stainless steel or the like. Accordingly, as illustrated in FIG. 14, the metal dome switch 40 has such FS characteristics that the operation repulsive force reaches a peak F1 of the operation repulsive force through, for example, a two-step quadratic curve in accordance with the operation stroke, and the operation repulsive force significantly reduces to an operation repulsive force F3 at the same time as the operation repulsive force exceeds the peak F1.

As described above, the load value (peak value) for pressing for the metal dome switch 40 is larger than that for the rubber dome switch 30, and the load variation amount for pressing the metal dome switch 40 is also larger than that for the rubber dome switches 30. As described above, the FS characteristics significantly differ between the rubber dome switch 30 and the metal dome switch 40, and operation sensation that the operator feels completely differs between the rubber dome switch 30 and the metal dome switch 40. In accordance with the FS characteristics of the rubber dome switch 30 and the metal dome switch 40, the rubber dome switch 30 is unlikely to generate the sensation that the operator feels, and in contrast, the metal dome switch 40 generates the sensation (tactile response) that the operator clearly feels.

Referring back to FIG. 12, after the rubber dome switch 30 disposed in the predetermined sliding operation direction has been turned on and the on signal of the rubber dome switch 30 has been transmitted to the controller 90, the metal dome switch 40 is turned on and the on signal of the metal dome switch 40 is transmitted next to the controller 90. Preferably, when the on signal of the rubber dome switch 30 disposed in the predetermined sliding operation direction and the on signal of the metal dome switch 40 are sequentially transmitted to the controller 90 as described above, the controller 90 performs determination of the operation direction and finishing of the input operation in this operation direction. Thus, at the time when the metal dome switch 40 is turned on, the operator can obtain a clear tactile response.

Variation of Multi-Directional Input Device

Next, a variation of the multi-directional input device is described with reference to FIGS. 15 and 16. Here, FIGS. 15 and 16 respectively correspond to FIGS. 12 and 13. An illustrated multi-directional input device 100A includes the operation knob 10A not to be subjected to sliding operation but to be subjected to inclination operation.

The operation knob 10A is configured such that the operation knob 10A has, for example, eight sliding operation directions, and as illustrated in FIGS. 15 and 16, when an upper end of the operation knob 10A is pressed downward in one of the directions by a pressing force P3, the operation knob 10A is inclined relative to the Z1-Z2 direction being the vertical direction by an angle θ2 and newly assumes an orientation along an inclination axis in the Z1'-Z2' direction.

When the operation knob 10A is subjected to inclination operation in a predetermined direction by the angle θ2, the first pressing member 60 disposed at a position corresponding to the inclination operation direction is pressed by the pressing force P1 downward in the Z2 direction in accordance with the inclination of the cam surface of the first cam 52 in the S1 direction, and the first pressing member 60 is pressed downward in the Z2 direction. Thus, the rubber dome switch 30 that is disposed below the first pressing member 60 and in the off state is pressed by the first pressing member 60. Consequently, the first movable contact 35 is brought into contact with the pair of first fixed contacts 36 so as to allow electrical conduction between the pair of the first fixed contacts 36. Thus, the rubber dome switch 30 is turned on. This causes the on signal of the rubber dome switch 30 to be transmitted to the controller 90.

Meanwhile, also in the second cam 54, when the inclination operation is performed on the operation knob 10A, the second pressing member 70 is guided in the S2 direction along the cam groove extending in the inclination operation direction and is pressed by the pressing force P2 downward in the Z2 direction in accordance with the inclination of the cam groove of the second cam 54 in the S2 direction, and the second pressing member 70 is pressed downward in the Z2 direction. Thus, the metal dome switch 40 that is disposed below the second pressing member 70 and in the off state is pressed by the second pressing member 70. Consequently, the second movable contact 44 is brought into contact with the pair of second fixed contacts 45 so as to allow electrical conduction between the pair of the second fixed contacts 45. Thus, the metal dome switch 40 is turned on. This causes the on signal of the metal dome switch 40 to be transmitted to the controller 90.

Also with the multi-directional input device 100A, when the operation knob 10A is subjected to the inclination operation and the metal dome switch 40 is turned on following the turning on of the rubber dome switch 30, the operator can obtain a clear tactile response.

A different embodiment in which a structure or the like described for the above-described embodiment is, for example, combined with a different element is possible, and the present invention is in no way limited to the structures described herein. In this regard, modification without departing from the gist of the present invention is possible, and determination can be appropriately made in accordance with a form to which the modification is applied. For example, although the metal dome switch 40 is applied as the sensation generation unit according to the above-described embodiment, a form in which the sensation generation unit includes only a metal dome so as to generate sensation with the metal dome is possible.

The present international application claims priority based on Japanese Patent Application No. 2018-075905 filed on Apr. 11, 2018, and the entire contents of the application noted above are hereby incorporated by reference.

What is claimed is:

1. A multi-directional input device comprising:

an operation knob configured to be operable in multiple operation directions;

a plurality of direction setting switches configured to be turned on by being pressed when the operation knob is operated;

a sensation generation unit configured to generate a different operation sensation from an operation sensation generated by the direction setting switches; and an inclination plate configured to be pressed when the operation knob is operated, wherein a sensation is generated by the sensation generation unit after at least one of the plurality of direction setting switches has been turned on in a predetermined operation direction out of the multiple operation directions, the inclination plate has a first cam formed by a truncated conical-shaped inclination surface or a truncated pyramid-shaped inclination surface, first pressing members configured to press the direction setting switches are disposed at a plurality of positions corresponding to the multiple operation directions in the first cam, the inclination plate further has a second cam having a plurality of cam grooves that extend in the multiple operation directions from a central point so as to be inclined along down slopes, and a second pressing member configured to be guided along one of the cam grooves provided in the second cam along a corresponding one of the down slopes so as to press the sensation generation unit is disposed on a sensation generation unit side of the second cam.

2. The multi-directional input device according to claim 1, wherein the direction setting switches are rubber dome switches.

3. The multi-directional input device according to claim 2, wherein the sensation generation unit is a metal dome switch.

4. The multi-directional input device according to claim 3, wherein a wiring board that includes a controller is disposed below the direction setting switches and the sensation generation unit, wherein first fixed contacts included in the rubber dome switches corresponding to the respective directions and a second fixed contact included in the metal dome switch are electrically connected to the controller in the wiring board, wherein the rubber dome switches have first movable contacts and the metal dome switch has a second movable contact, and wherein, when one of the rubber dome switches for a predetermined one of the operation directions is turned on due to contact of a corresponding one of the first fixed contacts with a corresponding one of the first movable contacts, and then, the metal dome switch is turned on due to contact of the second fixed contact with the second movable contact, the controller performs determination of the operation direction and finishing of an input operation in the operation direction.

5. The multi-directional input device according to claim 1, wherein a load value for pressing the sensation generation unit is greater than a load value for pressing the direction setting switches.

6. The multi-directional input device according to claim 1, wherein a load variation amount for pressing the sensation generation unit is greater than a load variation amount for pressing the direction setting switches.

7. A multi-directional input device comprising:

an operation knob configured to be operable in multiple operation directions;

a plurality of direction setting switches configured to be turned on by being pressed when the operation knob is operated; and a sensation generation unit configured to generate a different operation sensation from an operation sensation generated by the direction setting switches, wherein a sensation is generated by the sensation generation unit after at least one of the plurality of direction setting switches has been turned on in a predetermined operation direction out of the multiple operation directions, the direction setting switches are rubber dome switches, the sensation generation unit is a metal dome switch, a wiring board that includes a controller is disposed below the direction setting switches and the sensation generation unit, first fixed contacts included in the rubber dome switches corresponding to the respective directions and a second fixed contact included in the metal dome switch are electrically connected to the controller in the wiring board, the rubber dome switches have first movable contacts and the metal dome switch has a second movable contact, and when one of the rubber dome switches for a predetermined one of the operation directions is turned on due to contact of a corresponding one of the first fixed contacts with a corresponding one of the first movable contacts, and then, the metal dome switch is turned on due to contact of the second fixed contact with the second movable contact, the controller performs determination of the operation direction and finishing of an input operation in the operation direction.

8. The multi-directional input device according to claim 7, further comprising:

an inclination plate configured to be pressed when the operation knob is operated, wherein the inclination plate has a first cam formed by a truncated conical-shaped inclination surface or a truncated pyramid-shaped inclination surface, and wherein first pressing members configured to press the direction setting switches are disposed at a plurality of positions corresponding to the multiple operation directions in the first cam.

9. The multi-directional input device according to claim 8, wherein the inclination plate further has a second cam having a plurality of cam grooves that extend in the multiple operation directions from a central point so as to be inclined along down slopes, and wherein a second pressing member configured to be guided along one of the cam grooves provided in the second cam along a corresponding one of the down slopes so as to press the sensation generation unit is disposed on a sensation generation unit side of the second cam.

10. The multi-directional input device according to claim 7, wherein a load value for pressing the sensation generation unit is greater than a load value for pressing the direction setting switches.

11. The multi-directional input device according to claim 7, wherein a load variation amount for pressing the sensation generation unit is greater than a load variation amount for pressing the direction setting switches.

* * * * *